US006120384A

United States Patent [19]

Drake

[11] Patent Number: 6,120,384

[45] Date of Patent: Sep. 19, 2000

[54] CUSTOM-FABRICATED GOLF CLUB DEVICE AND METHOD

[76] Inventor: Stanley Drake, 26 Atlantic Ave., Blue Point, N.Y. 11715

[21] Appl. No.: 09/274,086

[22] Filed: Mar. 22, 1999

[51] Int. Cl.[7] ..... A63B 53/02

[52] U.S. Cl. ..... 473/248; 473/288; 473/305; 473/315; 473/409

[58] Field of Search ..... 473/244, 245, 473/246, 247, 248, 282, 287, 288, 305, 306, 307, 308, 309, 310, 311, 312, 313, 314, 315, 409; 29/428, 464, 467, 468, 557, 525.01, 724

[56] References Cited

U.S. PATENT DOCUMENTS

| | | |
|---|---|---|
| 1,352,020 | 9/1920 | Olson . |
| 1,946,134 | 2/1934 | Dyce . |
| 2,458,920 | 1/1949 | Wheeler . |
| 2,462,754 | 2/1949 | Lagerblade . |
| 3,931,969 | 1/1976 | Townhill . |
| 4,655,457 | 4/1987 | Thompson . |
| 4,804,184 | 2/1989 | Maltby . |
| 5,232,224 | 8/1993 | Zeider . |
| 5,244,205 | 9/1993 | Melanson . |
| 5,513,844 | 5/1996 | Ashcraft . |
| 5,564,994 | 10/1996 | Chang . |
| 5,626,528 | 5/1997 | Toulon . |
| 5,803,824 | 9/1998 | Rollingson . |
| 5,816,931 | 10/1998 | Schooler . |
| 5,851,155 | 12/1998 | Wood . |

*Primary Examiner*—S. Passaniti

[57] ABSTRACT

A custom-fabricated golf club device comprising a golf club head with a recessed portion located at the front heel portion of the head and machined therein, the recessed portion comprising a substantially semi-spherical aperture. A hosel assembly has a lower portion, having a substantially semi-spherical aperture that aligns with the aperture of the head recessed portion, the hosel assembly further having a recessed portion at an upper portion thereof. A steel ball is located securely within the aperture of head recessed portion and the aperture of the hosel assembly lower portion, functioning to provide positive location of the club head and hosel assembly. In the preferred mode, a permanent weldment functions to securely affix the lower portion of the hosel assembly to the club head at the heel portion of the club head. The device is utilized in conjunction with golf clubs of both the iron and wedge variety to provide a cost-effective and convenient way to custom-fabricate golf clubs to the unique physical characteristics of individual players. By taking advantage of machining, rather than forging or casting the components, a wide range of lie angles with precise resolution can be achieved. In addition, the manufacturing techniques of the present invention diligently conform to the USGA rule that clubs other than putters shall not be designed to be adjustable except for weight.

6 Claims, 3 Drawing Sheets

CUSTOM-FABRICATED GOLF CLUB DEVICE AND METHOD

BACKGROUND OF THE INVENTION

1. Field of the Invention

The present invention is a custom-fabricated golf club device and method. More particularly, it is an improved means to custom-fabricate golf clubs and irons to individual users in a cost effective manner, taking advantage of machining, rather than forging or casting the components. Specifically, the present invention is a means to better incorporate a golf club's "lie"—the angle that the shaft of the club, resting on the ground, makes with the horizontal. By utilizing a unique hosel to blade type weldment, and, in the preferred mode, machining a locating groove in the blade to which the hosel is joined, a wide range of lie angles with precise resolution can be achieved, where previous configurations provided for minimal adjustment. Moreover, the manufacturing techniques of the present invention diligently conform to USGA Rule 4-1a, relating to the design of clubs, which states that "Clubs other than putters shall not be designed to be adjustable except for weight."

2. Description of the Prior Art

Numerous innovations for golf club devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the present invention and the prior art.

U.S. Pat. No. 5,626,528 by Toulon

In U.S. Pat. No. 5,626,528, invented by Toulon, a golf club metal-wood head includes a unitary hosel having a continuous curved bottom groove extending completely about the hosel to form a reduced bending moment region enabling the making of reliable minor adjustments in both lie and face angle of the club to achieve custom fitting to individual players.

Importantly, the Toulon patent specifically claims that "In a practical construction of the invention, the club head and hosel were constructed of stainless steel and the wall thickness in the slot is approximately 0.060 inches. With this construction the club may be readily adjusted as much as 5 degrees in either direction for club face change and 7 degrees (up or down) for lie change without concern for damaging the club head or hosel integrity."

Distinction From The Toulon Invention

The present invention utilizes weldment of the hosel and blade, wherein a locating groove is machined in the blade, which creates a far greater degree of possible adjustment to the lie of the club than is available with the Toulon device, which pertains to metal woods, contrary to CGA rules.

U.S. Pat. No. 5,851,155 by Wood

U.S. Pat. No. 5,851,155, invented by Wood, a hosel construction includes a plug member extending downwardly for engaging a club head having a club face. A neck member, extending angularly upwardly from the plug member, engages a shaft to complete a golf club. The neck member extends in a generally transverse dimension to determine a lie angle between the shaft and the club head. The neck member also extends in a generally longitudinal dimension to determine a longitudinal angle, such as a face angle for the club face.

Distinction From The Wood Invention

Unlike the present invention, the invention to Wood relies upon the usage of a plug member within the heel portion of the club head. In the Wood device, the plug is adapted to receive a generally cylindrical neck piece, which receives the traditional shaft, an adjustable embodiment contrary to CGA rules.

U.S. Pat. No. 3,931,969 by Townhill invented by Townhill, an adjustable golf club adapted to serve the functions of a plurality of golf clubs has a single easily manipulated locking device accommodating adjustment of the club length, loft and lie angle. The club has a blade with a ball striking face, a curved hosel extending from the heel of the blade, a shaft with a fitting slidably receiving the hosel, and a locking screw securing the hosel in a number of related positions to reproduce the lengths, lofts and lie angles of, for example, Nos. 2–10 irons. Indicia on the hosel registers with a window in the fitting to identify the iron number for each adjusted position.

Distinction From The Townhill Invention

The present invention is distinguishable from this prior art patent, because the patent to Townhill discloses a single adjustable club, contrary to CGA rules, that is intended to replace a full set of iron clubs rather than better custom-fabricating each club to the individual user.

U.S. Pat. No. 5,564,994 by Chang

In U.S. Pat. No. 5,564,994, invented by Chang, described is a golf club head including a titanium face plate, a plurality of locating plates welded to the back side of the face plate for the positioning of the face plate in the male die section of a die, a casing molded on the face plate by pouring molten aluminum alloy in the female die section of the die, and covered over the locating plates and the back side of the face plate, wherein the face plate has a loop-like molding groove at the back side and a tapered periphery sloping outwards toward the back side for the engagement of the casing during the molding; each locating plate has a flat back section welded to the back side of the face plate, a smoothly curved springy front section for positioning in a respective locating groove on the male die section, an intermediate connecting section connected between the back section and the front section at one side, and a plurality of circular through holes at the intermediate connecting section for the passing of the molten aluminum alloy during the molding of the casing.

Distinction From The Chang Invention

Although the Chang device uses a locating groove, such is designed for usage with the conventional metal wood configuration, and can not apply to irons.

U.S. Pat. No. 5,513,844 by Ashcraft

In U.S. Pat. No. 5,513,844, invented by Ashcraft, described is a golf club fitting apparatus and method which utilizes a number of different club heads, the club heads having hosel or shaft receiving bores at different angles and securing devices for releasably securing a hosel at the lower end of a golf club shaft in the bore, and a number of different shafts. The heads have different parameters such as peripheral weighting, center of gravity, and face area in addition to different bore angles. A player can select various different head and shaft combinations to test. To test each combination, the hosel at the end of the shaft is inserted in the bore, and releasably secured in position. The player then tries it out. The shaft is released, and a new combination is tested in the same manner, until an optimum fit for that particular player is found.

Distinction From The Ashcraft Invention

Unlike the present invention, the Ashcraft device is designed as a testing means for golf clubs, with a hosel removably attachable to many heads rather than said pieces welded in place for permanent usage. Accordingly, such an apparatus is contrary to CGA rules.

U.S. Pat. No. 4,804,184 by Maltby

In U.S. Pat. No. 4,804,184, invented by Maltby, described is a wood golf club head formed of nonwood material comprises a bulbous body defining a face on one side for striking a golf ball. A hosel is integrally formed with and extends from the body for attaching a golf club shaft. A soleplate defines a spherical roll sole toward the toe of the head and a runner toward the heel of the head. The runner extends generally perpendicular to the ball striking face across the body to define a sole line for the head and is ground to adjust the head for fitting a golf club incorporating the head to an individual golfer. The lie of the golf club can be adjusted by uniformly grinding the runner and/or the face angle of the golf club can be adjusted by grinding the runner to slope toward or away from the ball striking face of the head.

Distinction From The Maltby Invention

As distinguished from the present invention, which does not apply to wood or metal wood clubs, the invention by Maltby is designed specifically for usage upon wood clubs and relies on grinding a runner for lie adjustment purposes.

U.S. Pat. No. 4,655,457 by Thompson

In U.S. Pat. No. 4,655,457, invented by Thompson, described is a system for fitting a golf club to a user-golfer and employing a fitting club having a shaft, a handle on the shaft, and a head having a face. The system includes (a) a first pivot on the golf club proximate the head to accommodate adjustment pivoting of the head relative to the shaft, and to a selected angular position about an axis extending generally transversely to the shaft, (b) and an indicator associated with pivot to indicate the extent of said adjustment pivoting, corresponding to "lie" of the head, Also provided is a second such pivot allowing adjustment pivoting of the head 90 degrees relative to the shaft and about the shaft axis, and to a position wherein the head is adjustably pivotable about the first axis, and the same indicator is thus usable to indicate adjusted head face angularity.

Distinction From The Thompson Invention

As distinguished from the present invention, the invention by Thompson discloses only a "fitting club" for a golfer to test during game conditions, the fitting club able to be adapted to the particular preferences of the golfer and then used as an example for future manufacture of custom clubs. The present invention teaches the usage of custom-fabricated clubs, designed so as not to allow adjustability.

U.S. Pat. No. 5,232,224 by Zeider

In U.S. Pat. No. 5,232,224, invented by Zeider, a golf club head of the metalwood type is made from several components welded together along parting lines. A head base has a sole plate formed integrally with a heel, toe and back wall for the club, and has open front and upper faces across which a face plate and crown plate, respectively, are welded. The base, face plate and crown plate are all stamped sheet metal parts. A hosel tube projects upwardly at a desired lie angle from the base through an opening in the crown plate. The various parts are held together at selected loft and lie angles in suitable holding fixtures before being welded in place, so that heads can be custom made with different head geometries using the same basic tooling.

Distinction From The Zeider Invention

Unlike the present invention, which applies to irons and wedges, the Zeider invention describes a method of making a golf club head of the metal-wood type, which comprises the steps of stamping a head base, face plate and crown plate from sheet metal material, the head base being stamped to form a sole plate integrally with a heel, toe and back wall, and having an open front face and open top face, securing the face plate to the open front face of the base at a selected loft angle, and securing the crown plate and a hosel tube to the open top face of the base with the hosel tube projecting at any one of a range of possible lie angles from the crown plate. In the Zeider invention, the club head is designed to be more uniform and precise in its characteristics than a similar cast metal-wood club head, since cold stamped sheet metal does not have the weight variations of a cast metal.

U.S. Pat. No. 5,803,824 by Rollingson

In U.S. Pat. No. 5,803,824, invented by Rollingson, disclosed is a golf putter having a lie and offset adapter for selectively setting and/or adjusting the lie and offset of the putter. The adapter may comprise a spacer having a lower socket extending from a first end along a first longitudinal axis and a second socket extending from a second end along a second longitudinal axis. The length of the spacer and the orientation of the sockets are set to provide the desired lie and offset of the putter. The golf putter has a head with a face for striking a golf ball, a lower shaft segment and an upper shaft segment. The head is connected to a lower shaft segment which, in turn, is attached to the lower socket of the adapter. A lower end portion of the upper shaft segment connects to the upper socket of the adapter. Alternatively, the open end of a hosel, which extends from the putter head, may take the place of the lower shaft segment. The lie and offset of the putter are selectively set during assembly by installing an adapter configured for the desired lie and offset. The lie and offset of the putter also may be adjusted after assembly by altering or replacing the adapter.

Distinction From The Rollingson Invention

Unlike the present invention, the patent to Rollingson protects a device specifically intended for usage in conjunction with putters, and not irons and wedges U.S. Pat. No. 5,244,205 by Melanson In U.S. Pat. No. 5,244,205, invented by Melanson, described is an adjustable lie angle putter having an infinite degree of adjustment between a 56° and 79.9° angle from the zero ground plane. The putter head has an elongated slot therein located on the upper surface of the putter with aligned boreholes in the walls of the slot. The shaft is secured to a hosel member which terminates in a tang having parallel flat sides which mate with the slot. A borehole extends through the tang between the flat sides. A pin is secured in said boreholes so as to pivotally secure said tang in said slot. The upper surface of the tang forms arcuate surfaces on opposite sides of the shaft which terminate in flat planar surfaces. The flat planar surfaces terminate in two substantially flat bearing surfaces which meet at an angle. Two threaded boreholes extend angularly through the sole of the putter into the slot and two adjustable setscrews are secured with the boreholes. When the tang is pivotably secured in the slot by the pin, the angle of the shaft may be set by rotating the tang and then securing the setscrews, each of which mates with an associated flat bearing surface. Additionally, the flat planar surfaces limit the degree of adjustment by mating with the end walls of the slot when maximum clockwise and counterclockwise pivotal movement is reached.

Distinction From The Melanson Invention

Once again, unlike the present invention, the patent to Melanson protects a device specifically intended for usage in conjunction with putters, and not irons and wedges.

SUMMARY OF THE INVENTION

As mentioned above, the present invention is a custom-fabricated golf club device and method. Because the present invention utilizes a unique hosel to blade type weldment, as well as the machining of a locating groove in the blade to which the hosel is joined, a great degree of adjustment to the lie of the club can be achieved, providing far greater versatility than the configurations taught by the prior art.

It is important to note that the principal feature of custom manufacture, as is currently known in the art, involves an adjustment of the length of the club and its lie. Although weighting, weight distribution of the club, and the flex of the shaft are significant factors, the manner in which a club, ill-fitted for length and lie forces the player to swing poorly may have a lasting effect on the player's game. Length adjustment of a club is a relatively simple matter, but modification of the lie of a club, and particularly an iron club, is far more difficult.

The prior art teaches the usage of a system whereby a club maker adjusts the lie of the club by bending the hosel, or neck portion of the club head. This adjustment is most often limited to a range of fewer than two degrees of movement for most commonly used materials.

In contrast, the present invention utilizes a hosel to blade type weldment and locating groove, with the result that a wide range of lie angles with precise resolution can be achieved.

As such, it is an object of the present invention to provide a club that best suits the individual golfer, taking into account all relevant physical characteristics of said individual, including, but not limited to the height of the user, the strength of the user, and the preferred stance of the user.

It is a further object of the present invention to provide a club that enhances the level of play of the golfer, supplying the best club available to each golfer for optimal performance.

It is also an object of the present invention to provide a club that allows the golfer the greatest degree of comfort and least degree of physical strain during play, as utilization of the present invention dispenses with the need for the golfer to conform to a club inadequately designed for the individual characteristics of the golfer.

Moreover, it is also an object of the present invention to provide a convenient and cost-effective method of producing the custom-fabricated clubs as described above, as the principal components, produced separately, are cut and welded to fit one another.

It is further an object of the present invention to provide a means for an iron head to utilize the cost-effective method of computer numerically controlled machining. The design of such iron intentionally accommodates this practice by concentrating its weight in the form of a block that is preferably milled in order to functionally duplicate a forged iron head.

It is still another object of the present invention to provide a method of producing custom-fabricated clubs that greatly mitigates the degree of swollen inventory for producers and sellers, as each club is uniquely created to suit the individual physical characteristics of the golfer.

The novel features which are considered characteristic for the invention are set forth in the appended claims. The invention itself, however, both as to its construction and its method of operation, together with additional objects and advantages thereof, will be best understood from the description of the specific embodiments when read and understood in connection with the drawings.

BRIEF DESCRIPTION OF THE PREFERRED EMBODIMENT

DETAILED DESCRIPTION OF THE PREFERRED EMBODIMENT

The foregoing will describe the principal components of the present invention as distinguished from the prior art. Typically, a golf club head of an iron consists of the blade portion and the hosel, or neck piece. Although the prior art devices regarded such as inseparable, the present invention aims to manufacture the hosel and the blade separately and then join them in such a manner as to more adequately suit the individual user.

Figure 1:
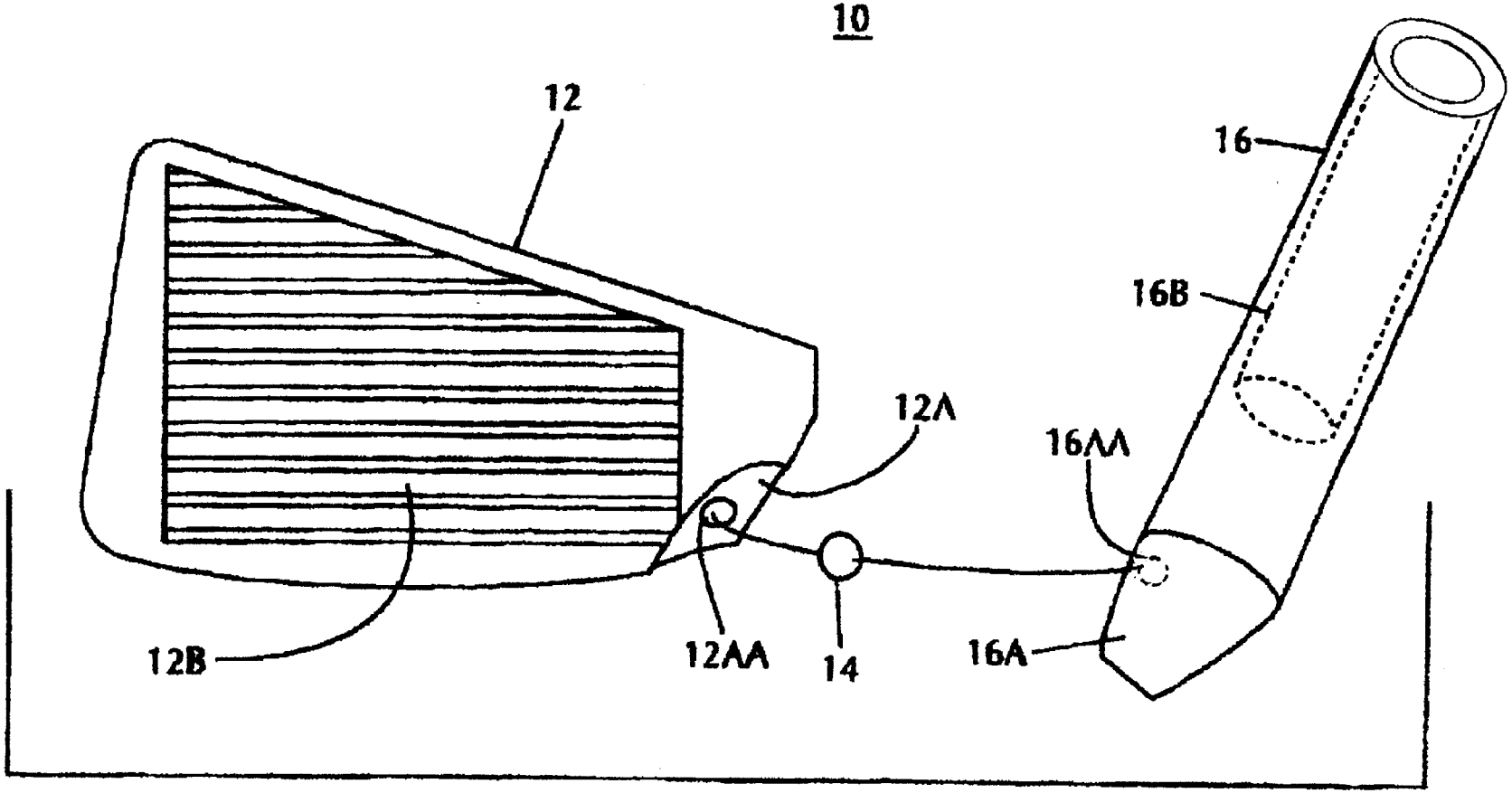
FIG. 1 is an exploded view of the hosel assembly, steel ball, and club head of the present invention, wherein the hosel assembly is rotated in a counter-clockwise manner and the upper portion of the hosel assembly leans away from the viewer.

Firstly, referring to FIG. 1, which is an exploded view of the hosel assembly, steel ball, and club head of the present invention: illustrated is the custom-fabricated golf club device (10), golf club head (12), golf club head recessed portion (12A), golf club head aperture (12AA), golf club head face portion (12B), steel ball (14), hosel assembly (16), hosel assembly lower portion (16A), hosel assembly aperture (16AA), recess at upper portion of hosel (16B), and attachment means (18).

More particularly, the custom-fabricated golf club device (10) comprises a golf club head (12) which comprises a golf club head recessed portion (12A) located at the front of the heel portion of the club head (12) and machined therein. The recessed portion (12A) comprises an aperture (12AA), the aperture substantially semispherical in nature. As in the instance of traditional club heads, the golf club head (12) of the present invention further comprises a face portion (12B) functioning to come in contact with a golf ball during a golf swing.

A substantially cylindrical hosel assembly (16) comprises a lower portion (16A), the lower portion (16A) comprising a hosel assembly aperture (16AA). Much as in the instance of the aperture (12AA) of golf club head recessed portion (12A), the aperture substantially is semi-spherical in nature and aligns along the vertical axis with the aperture (12AA) of golf club head recessed portion (12A). As in the instance of traditional hosel pieces, the hosel assembly (16) further comprises a recessed portion (16B) at an upper portion thereof, such recess deigned to receive the lower portion of the golf club shaft during manufacture and assembly.

A steel ball (14) is located securely within the aperture (12AA) of golf club head recessed portion (12A) and the aperture (16AA) of the hosel assembly lower portion (16A). Importantly, the steel ball (14) functions to provide positive location of the club head and hosel assembly.

Moreover, an attachment means (18) functions to securely affix the lower portion of the hosel assembly to the golf club head at the heel portion of the golf club head. In the preferred mode, the attachment means is a permanent weldment, representing the most significant departure from the manufacturing and assembly techniques of the prior art offered by the present invention.

It is important to note, regarding the method of manufacturing and assembling the device of the present invention, that the heel surface conforms approximately to the stipulated USGA heel radius of the blade, as the weldment of the present invention will preferably be ground and finished.

Two remaining surfaces are then tapered to a natural-type configuration. A reference point is established as a machining guide and lies in the plane formed by the club face, and in the plane that is substantially orthogonal to the club face. Accordingly, such is parallel to the grooves of the face portion and tangent to the leading edge radius of the sole of the club.

This aforementioned reference point is the point aligned with the centerline of the hosel assembly, thereby assuring an advantageous zero offset configuration. The offset, or the deviation of the central axis of the hosel from the leading edge of the club face, is often produced as a manufacturing convenience, providing little benefit to the user.

For the purposes of example, the process for assembling the hosel to the iron blade considers the typically marketed loft and lie angles of a five iron, which are 28 degrees and 60 degrees respectfully. The hosel of the present invention is manufactured as a standard design, though the hosels produced for higher loft irons in particular may vary. The tip of such is the combination of a total of four surfaces, which include the continuation of the cylindrical surface of the hosel, which is approximately five-eights of one inch in diameter in the preferred mode. As mentioned above, such is then brought in intimate contact with a groove that is machined in the club head or blade. That surface is then machined for an aperture that will align with a second substantially similar aperture in the recessed portion of the club head or blade.

Figure 2:
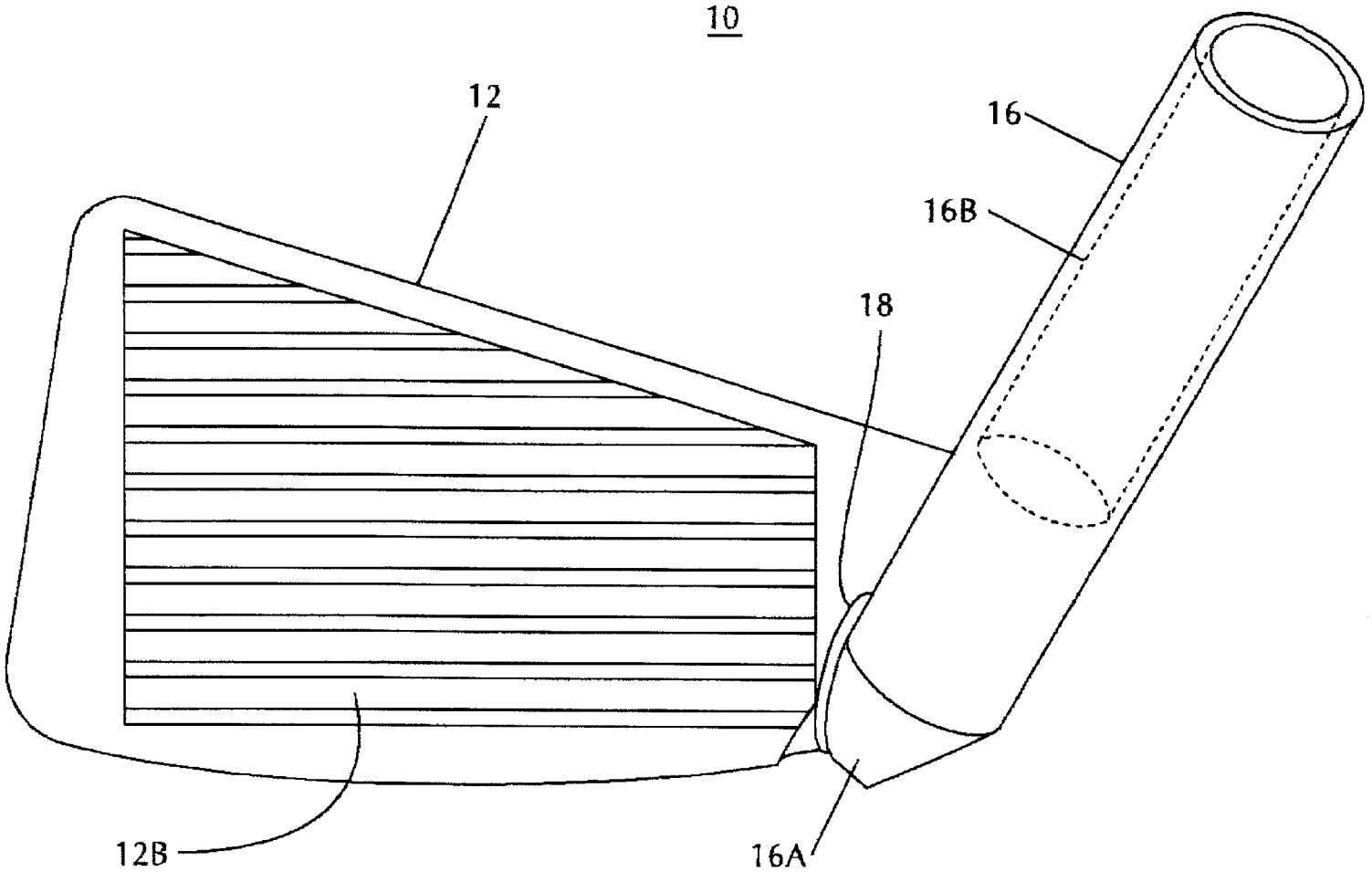
FIG. 2 is a front perspective view of the custom-fabricated golf club device of the present invention.

Secondly, referring to FIG. 2, which is a front perspective view of the custom-fabricated golf club device of the present invention: illustrated are the principal components welded together in accordance with the above-described method.

Figure 3:
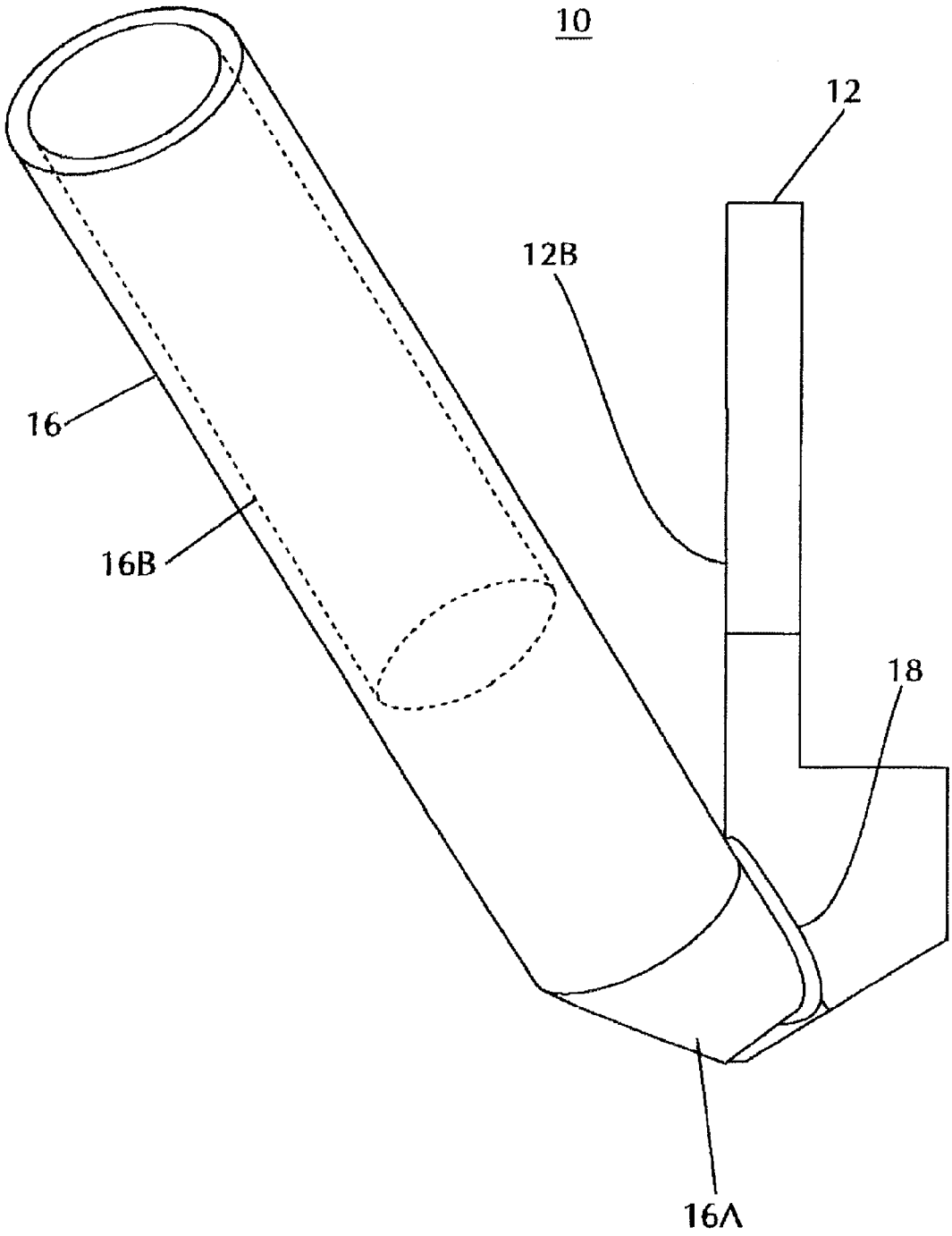
FIG. 3 is a side perspective view of the custom-fabricated golf club device of the present invention.

Thirdly, referring to FIG. 3, which is a side perspective view of the custom-fabricated golf club device of the present invention: illustrated once again are the principal components welded together in accordance with the above-described method. Importantly, the unique weldment of the present invention is not readily apparent from the exterior of the club, as the club maintains a substantially ordinary appearance.

In total, the device of the present invention is intended to be utilized in conjunction with a golf club of the iron variety, in which case the golf club may be selected from the group consisting of a one-iron, two-iron, three-iron, four-iron, five-iron, six-iron, seven-iron, eight-iron, and nine-iron. In addition, the device may be utilized in conjunction with a golf club of the wedge variety for optimal performance therewith.

As described in the summary herein, the prior art teaches adjustment of the lie of the club by bending the hosel, and is most often limited to a range of one or two degrees of movement. In contrast, the present invention utilizes a hosel to blade weldment and apertures which function as a locating groove, resulting in a substantially infinite degree of adjustment to the lie of the club. As such, it is an object of the present invention to provide a club that best suits the individual golfer, taking into account all relevant physical characteristics of said individual, including, but not limited to the height of the user, the strength of the user, and the preferred stance of the user.

Specifically, the lie angle is the angle that the hosel and the shaft forms with the ground, if the club head is placed so that it rests on a level surface, parallel to the grooves on the face of the club. This angle should be adjustable to suit the physical characteristics golfer, who is often forced to adjust to the club when utilizing devices taught by the prior art. It is well known in the field that this situation has the potential of causing an off-line shot, as the golfer, usually because of the player's height, raises or lowers the lie angle, causing the ball to deviate to the right or the left in an undesired manner. It is respectfully submitted that the device of the present invention solves this problem in the most convenient and cost-effective manner, much to the benefit of the amateur or professional player.

It will be understood that each of the elements described above, or two or more together, may also find a useful application in other types of constructions differing from the type described above.

While the invention has been illustrated and described as embodied in a corner protection device, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can, by applying current knowledge, readily adapt it for various applications without omitting features that, from the standpoint of prior art, constitute essential characteristics of the generic or specific aspects of this invention.

What is claimed as new and desired to be protected by letters patent is set forth in the appended claims.

REFERENCE NUMERALS IN DRAWINGS

10—custom-fabricated golf club device
12—golf club head
12A—golf club head recessed portion
12AA—golf club head aperture
12B—golf club head face portion
14—steel ball
16—hosel assembly
16A—hosel assembly lower portion
16AA—hosel assembly aperture
16B—recess at upper portion of hosel
18—attachment means

What is claimed is:

1. A custom-fabricated golf club device (10) comprising:

A) a golf club head (12) which comprises a golf club head recessed portion (12A) located at the front of the heel portion of the club head (12) and machined therein, the recessed portion (12A) comprising a golf club head aperture (12AA), the aperture substantially semi-spherical in nature, the golf club head (12) further comprising a face portion (12B) functioning to come in contact with a golf ball during a golf swing;

B) a hosel assembly (16) comprising a hosel assembly lower portion (16A), the hosel assembly lower portion (16A) comprising a hosel assembly aperture (16AA), the aperture substantially semi-spherical in nature and aligning with the aperture (12AA) of golf club head recessed portion (12A), the hosel assembly (16) further comprising a recessed portion (16B) at an upper portion thereof;

C) a steel ball (14) located securely within the aperture (12AA) of golf club head recessed portion (12A) and the aperture (16AA) of the hosel assembly lower portion (16A), the steel ball (14) functioning to provide positive location of the club head and hosel assembly; and D) an attachment means (18) functioning to securely affix the lower portion of the hosel assembly to the golf club head at the heel portion of the golf club head.

2. The custom-fabricated golf club device (10) as described in claim 1, wherein the device is utilized in conjunction with a golf club of the iron variety.

3. The custom-fabricated golf club device (10) as described in claim 2, wherein the device is utilized in conjunction with a golf club selected from the group consisting of a one-iron, two-iron, three-iron, four-iron, five-iron, six-iron, seven-iron, eight-iron, and nine-iron.

4. The custom-fabricated golf club device (10) as described in claim 1, wherein the device is utilized in conjunction with a golf club of the wedge variety.

5. The custom-fabricated golf club device (10) as described in claim 1, wherein the attachment means is a permanent weldment.

6. A method of producing a custom-fabricated golf club device comprising the steps of:

A) machining a recessed portion into a golf club head at the front of the heel portion of the club head;

B) creating an aperture within the recessed portion of the golf club head, the aperture substantially semi-spherical in nature;

C) creating an aperture within a lower portion of a hosel assembly, the aperture substantially semi-spherical in nature and aligning with the aperture of the golf club head recessed portion;

D) positioning a steel ball securely within the aperture of golf club head recessed portion and the aperture of the hosel assembly lower portion, the steel ball functioning to provide positive location of the club head and hosel assembly; and E) securely welding the lower portion of the hosel assembly to the golf club head at the heel portion of the golf club head, wherein the hosel assembly is positioned at a previously determined desired angle.

* * * * *